US007984627B2

(12) United States Patent
Huang et al.

(10) Patent No.: US 7,984,627 B2
(45) Date of Patent: Jul. 26, 2011

(54) METHOD FOR MAKING LIFE VEST HAVING DOUBLE-KNITTED FABRICS

(75) Inventors: Yung-Mao Huang, Taoyuan (TW); Ming-Lung Wu, Taoyuan (TW)

(73) Assignee: Trueway Corporation, Taoyuan County (TW)

( * ) Notice: Subject to any disclaimer, the term of this patent is extended or adjusted under 35 U.S.C. 154(b) by 240 days.

(21) Appl. No.: 12/479,832

(22) Filed: Jun. 7, 2009

(65) Prior Publication Data

US 2010/0307199 A1 Dec. 9, 2010

(51) Int. Cl.
*D04B 1/22* (2006.01)

(52) U.S. Cl. ..... 66/176; 66/196; 441/106

(58) Field of Classification Search ..... 66/169 R, 66/170, 171, 176, 202, 196; 441/102, 106, 441/108

See application file for complete search history.

(56) References Cited

U.S. PATENT DOCUMENTS 3,204,264 A * 9/1965 Tamura et al. ..... 441/102
4,547,165 A * 10/1985 Scheurer et al. ..... 441/112
5,184,968 A * 2/1993 Michalochick et al. ..... 441/116
5,413,837 A * 5/1995 Rock et al. ..... 428/192
5,693,412 A * 12/1997 Walters ..... 428/317.1
6,712,658 B1 * 3/2004 Crossley et al. ..... 441/106
7,024,891 B2 * 4/2006 Huang et al. ..... 66/176
2010/0279565 A1 * 11/2010 Shiue ..... 441/88

* cited by examiner

*Primary Examiner* — Danny Worrell
(74) *Attorney, Agent, or Firm* — Alan Kamrath; Kamrath & Associates PA

(57) ABSTRACT

A method for making a life vest includes making first and second double-knitted fabrics from an artificial filament. Each of the first and second double-knitted fabrics includes inner and outer cloth layers. The first and second double-knitted fabrics are dyed. Then, the inner cloth layer of each of the first and second double-knitted fabrics is processed to form a brush structure on the inner cloth layer. The brush structure and the inner and outer layers of each of the first and second double-knitted fabrics undergo a heat-setting process so that the sizes of the brush structure and the inner and outer layers of each of the first and second double-knitted fabrics are stabilized. The first and second double-knitted fabrics are cut and sewn so that the outer cloth layers face outward and that the inner cloth layers face each other. A buoyant material is filled between a receiving space defined between the inner cloth layers.

6 Claims, 7 Drawing Sheets

METHOD FOR MAKING LIFE VEST HAVING DOUBLE-KNITTED FABRICS

BACKGROUND OF THE INVENTION

The present invention relates to a method for making a life vest and, more particularly, to a method for making a life vest having two double-knitted fabrics to shorten the processing time, to increase the thickness of the fabrics, to increase the processing efficiency, and to reduce the labor hours and the material costs.

FIGS. 1-3 show a conventional life vest 9 and FIG. 4 shows a method for making the life vest. The life vest 9 includes two rubber sponge sheets 91 and 92 and a buoyant material 97 between the rubber sponge sheets 91 and 92. Each rubber sponge sheet 91, 92 include two fabrics 93 and 94 and a rubber sponge 97 sandwiched between the fabrics 93 and 94. The buoyant material 97 is sandwiched between the fabrics 93 and 94. The fabrics 93 and 94 are prepared by weaving or knitting (see 901). The fabrics 93 and 94 are then treated with a dyeing process (see 902). Thereafter, a rubber sponge 95 is sandwiched between the dyed fabrics 93 and 94 in a lamination process (see 903) to form the rubber sponge sheets 91 and 92. The rubber sponge sheets 91 and 92 are cut and sewed, so that the buoyant material 97 is filled between the rubber sponge sheets 91 and 92 in each sewing area 96 to form the life vest 9. The rubber sponge 95 is elastic and hydrophobic and, thus, has long been the best choice for making the life vest 9. However, the life vest 9 is not permeable to air, so that the wearer feels hot and uncomfortable. Furthermore, the rubber sponge 95 is liable to become flimsy and has odor and causes environmental pollution after they are discarded. Furthermore, the yield of the life vest 9 is low if the quality control in the lamination process is poor.

To overcome the disadvantages of the life vest 9, U.S. Pat. No. 7,024,891 discloses a method for making a life vest includes knitting or weaving, dyeing, and sewing. In the knitting or weaving, a material including synthetic filament synthetic monofilament and elastic yarn is combined by a double weft knitting machine to make a textile for the life vest. However, the knitting or weaving process is complicated, slow, and expensive. Furthermore, the elastic yarn in the life vest still has the tendency of becoming flimsy.

Thus, a need exists for an improved method for making a life vest without the disadvantages of conventional life vests.

BRIEF SUMMARY OF THE INVENTION

The present invention solves this need and other problems in the field of life vests by providing a method for making a life vest including making first and second double-knitted fabrics from an artificial filament. Each of the first and second double-knitted fabrics includes an inner cloth layer and an outer cloth layer. The first and second double-knitted fabrics are dyed. Then, the inner cloth layer of each of the first and second double-knitted fabrics is processed to form a brush structure on the inner cloth layer. The brush structure and the inner and outer layers of each of the first and second double-knitted fabrics undergo a heat-setting process so that the sizes of the brush structure and the inner and outer layers of each of the first and second double-knitted fabrics are stabilized. The first and second double-knitted fabrics are cut and sewn so that the outer cloth layers face outward and that the inner cloth layers face each other. A buoyant material is filled between a receiving space defined between the inner cloth layers.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

Figure 1:
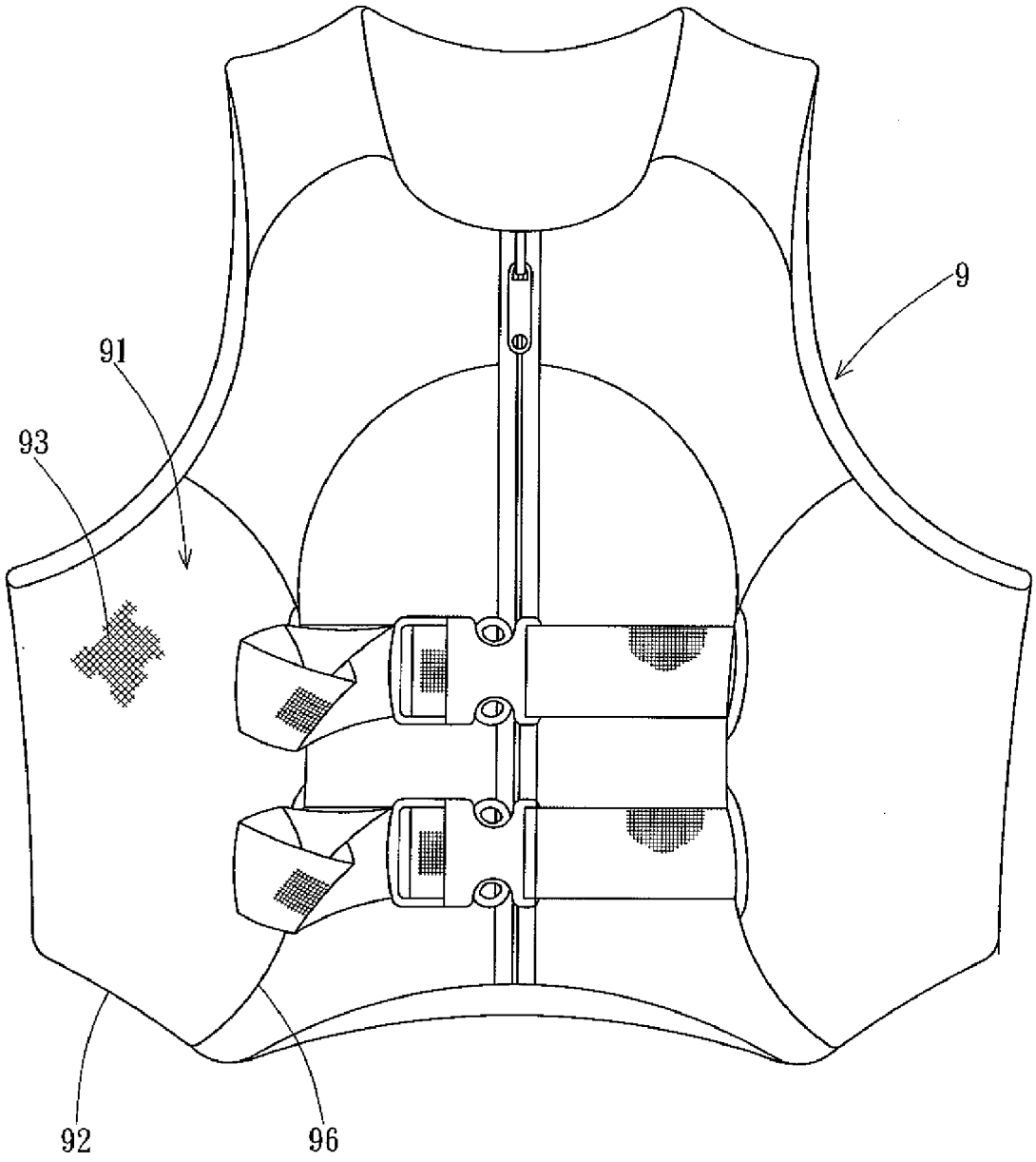
FIG. 1 PRIOR ART
FIG. 1 shows a front view of a conventional life vest.
Figure 2:
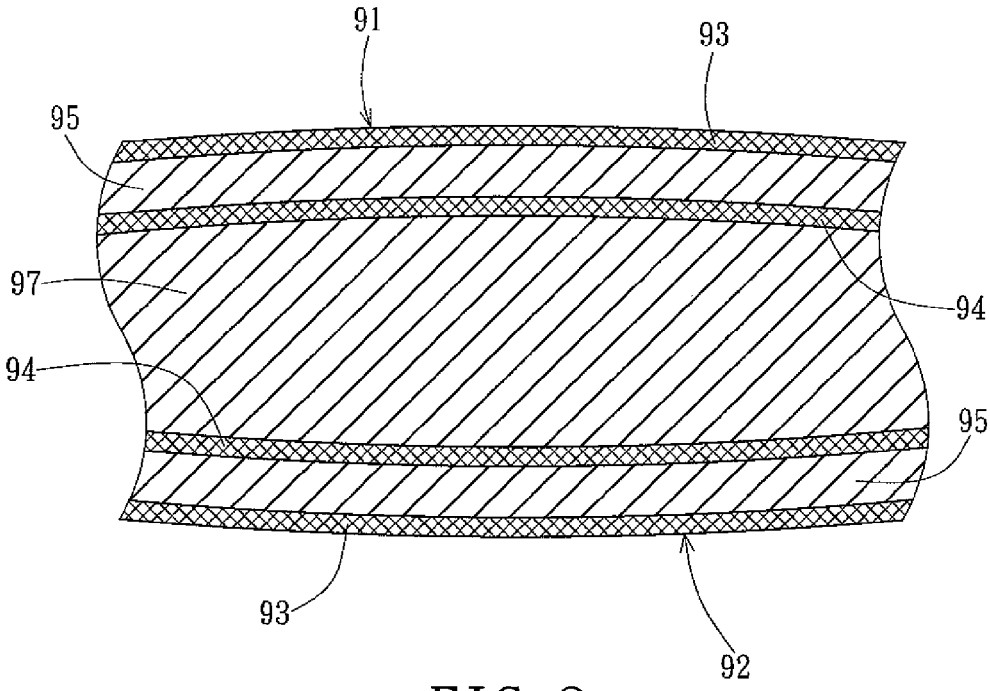
FIG. 2 PRIOR ART
FIG. 2 shows a partial, cross sectional view of the life vest of FIG. 1
Figure 3:
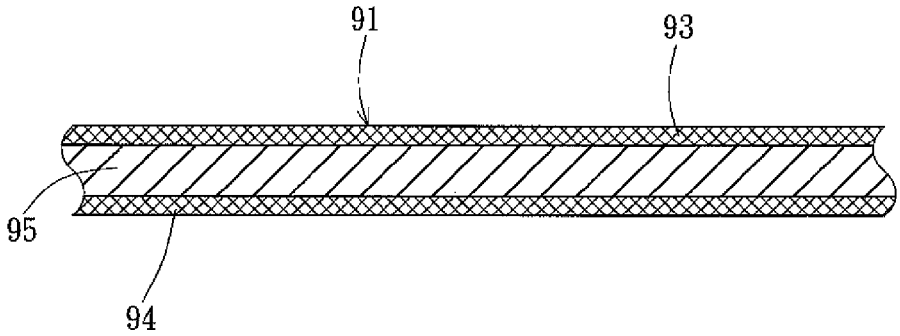
FIG. 3 PRIOR ART
FIG. 3 shows a partial, cross sectional view of a rubber sponge sheet of the life vest of FIG. 1.
Figure 4:
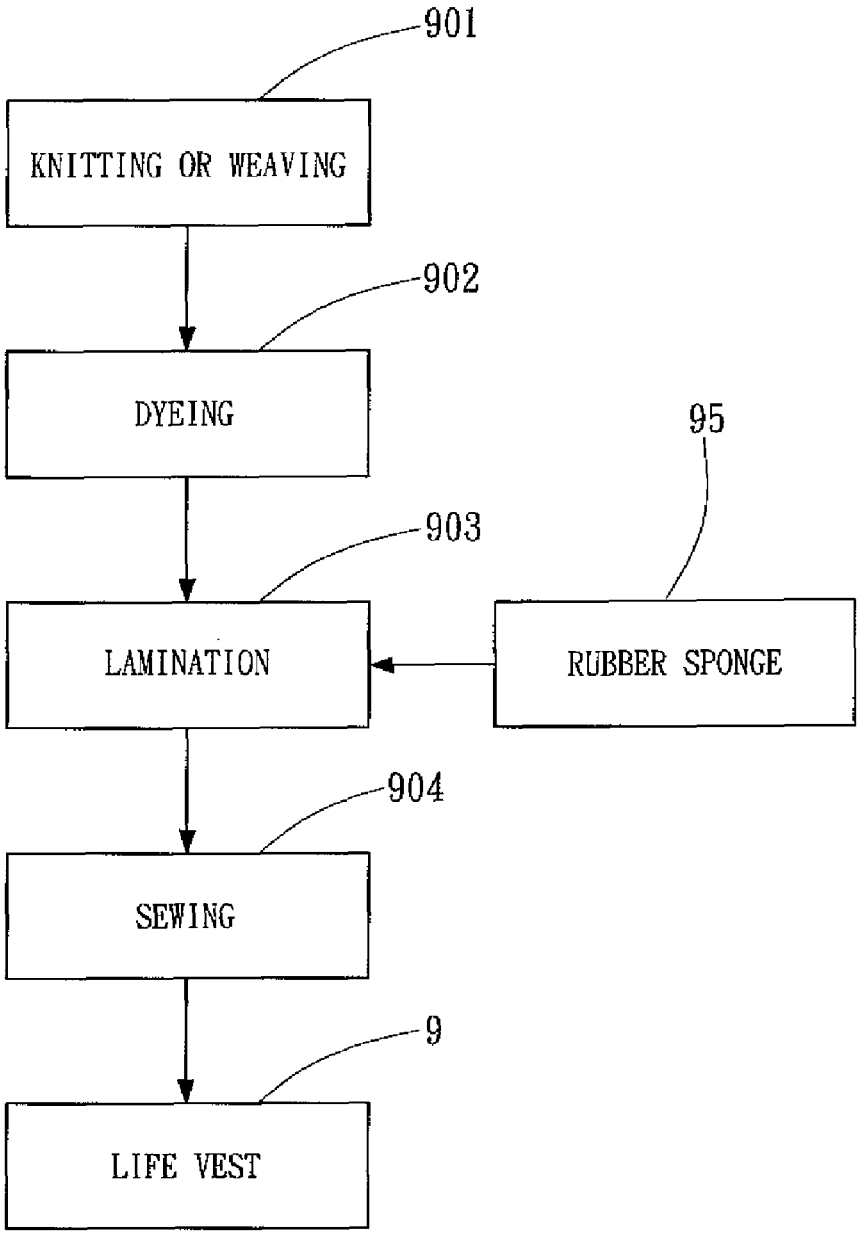
FIG. 4 PRIOR ART
FIG. 4 shows a flow chart of a method for making the conventional life vest of FIG. 1.
Figure 5:
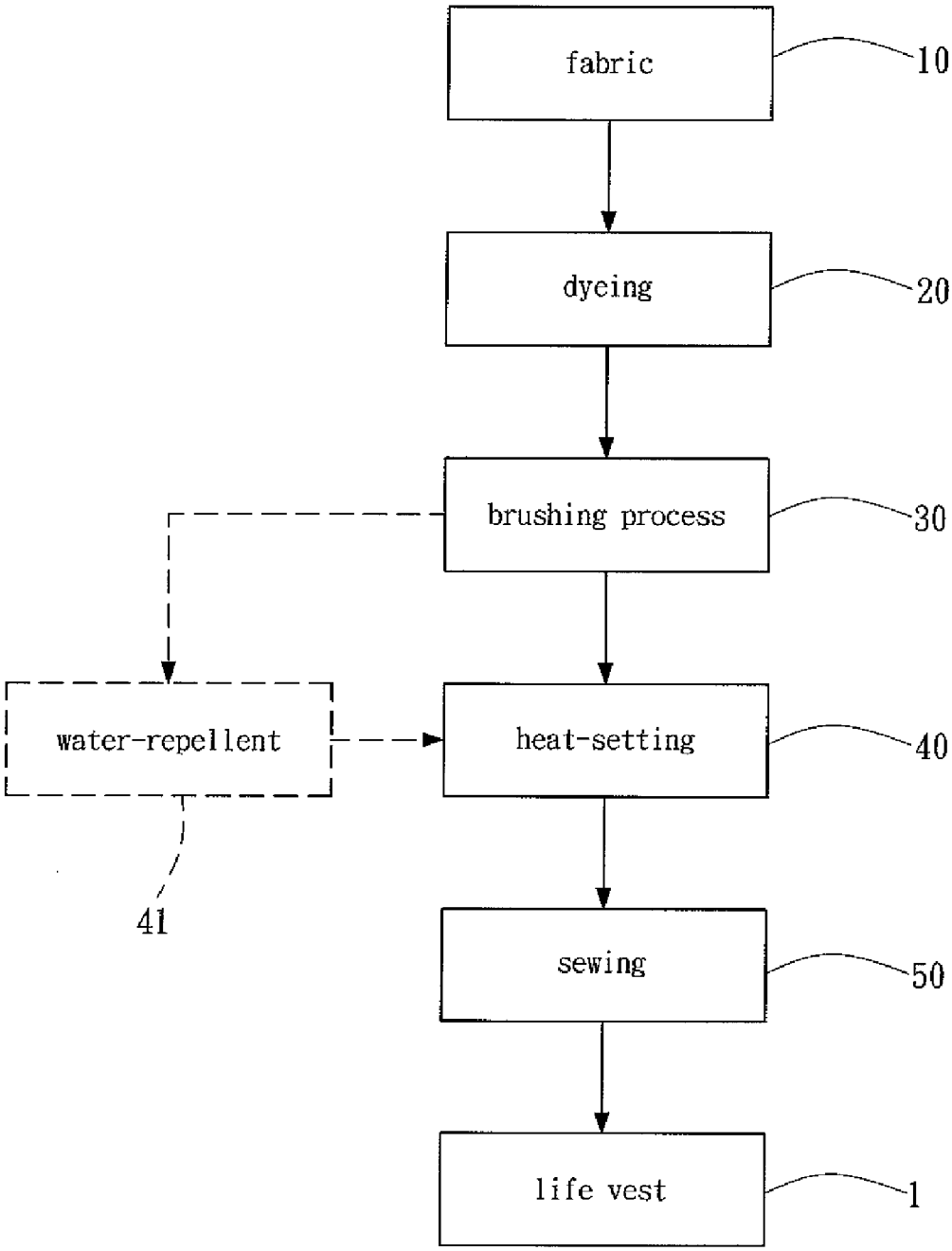
FIG. 5 shows a flow chart of a method for making a life vest according to the preferred teachings of the present invention.
Figure 6:
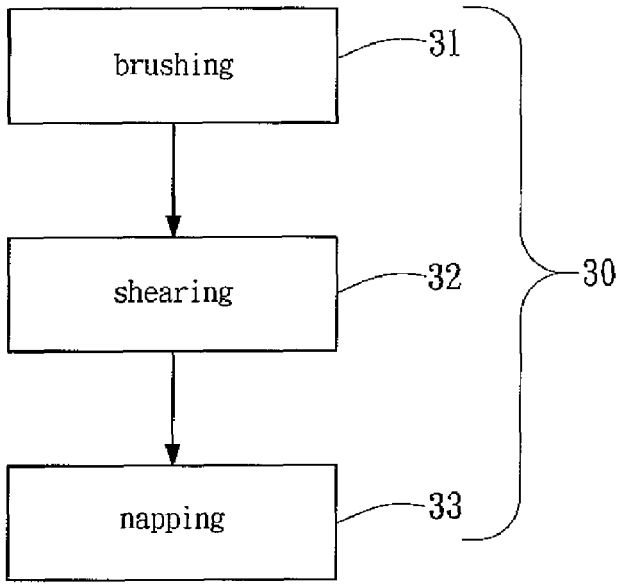
FIG. 6 shows a flow chart of a brushing process of the method for making the life vest according to the preferred teachings of the present invention.
Figure 7:
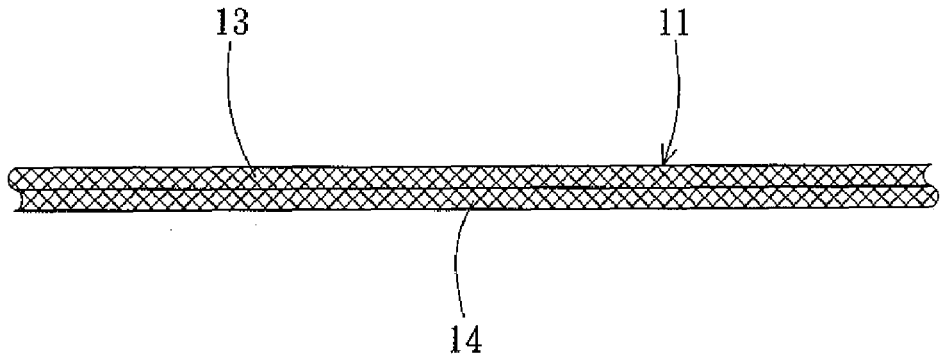
FIG. 7 shows a double-knitted fabric of a life vest made by the method according to the preferred teachings of the present invention.

FIG. 5 shows flow chart of a method for making a life vest according to the preferred teachings of the present invention. At 10, a double-knitted fabric 11 containing inner and outer cloth layers 13 and 14 is made by knitting or weaving an artificial filament by such as a circular knitting machine. The artificial filament is selected from at least one of a group consisting of a polyester filament, a polyamide filament, and a polypropylene filament and a combination thereof. The artificial filament can be knitted by a double knitting machine, a single knitting machine, or a terry knitting machine.

Figure 8:
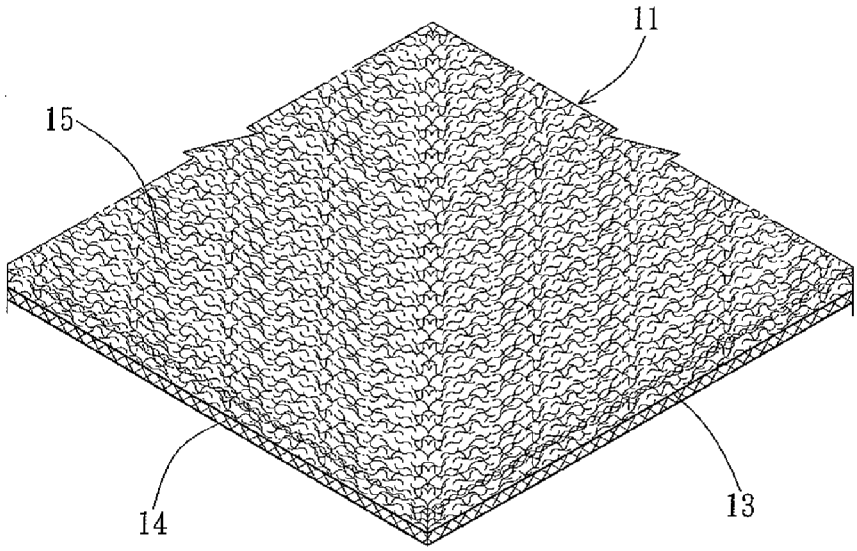
FIG. 8 shows a partial, perspective view of a brush structure obtained from the double-knitted fabric of FIG. 7 after the brushing process.
Figure 9:
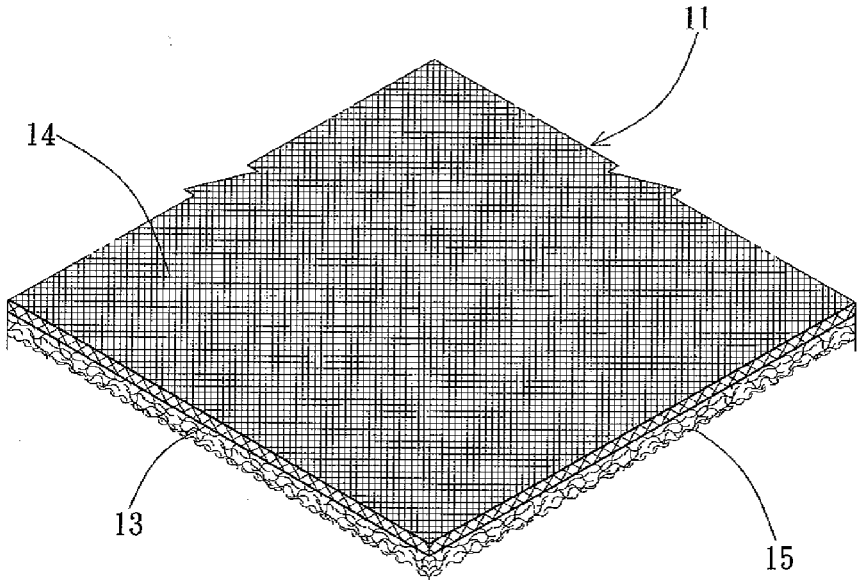
FIG. 9 shows a partial bottom, perspective view of the brush structure of FIG. 8.
Figure 10:
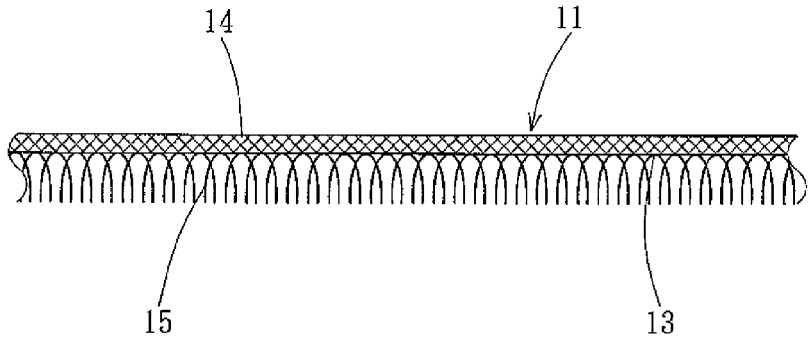
FIG. 10 is a cross sectional view of the brush structure of FIG. 9.
Figure 11:
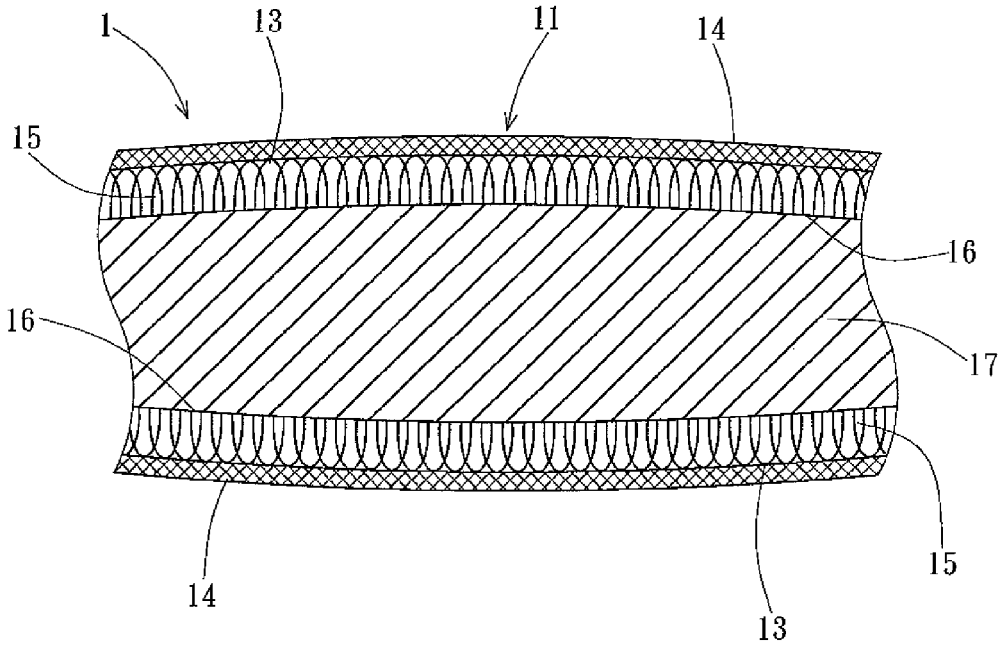
FIG. 11 shows a cross sectional view of a life vest according to the preferred teachings of the present invention.

At 20, the double-knitted fabric 11 is dyed. At 30, the dyed inner cloth 13 of the double-knitted fabric 11 undergoes a brushing process to obtain a brush structure 15 on the inner cloth layer 13 (FIGS. 8-10). The overall thickness of the inner cloth layer 13 and the brush structure 15 is larger than the thickness of the outer cloth layer 14 to increase the overall thickness of the double-knitted fabric 11 and to enhance the firmness of the cloth. In the brushing process 30, the inner cloth layer 13 undergoes a brushing procedure at 31 to form the brush structure 15. The brush structure 15 of the inner cloth layer 13 can undergo a shearing procedure at 32 and a napping procedure at 33 to provide firm hand-feel.

At 40, the inner and outer cloth layers 13 and 14 and the brush structure 15 undergo a heat-setting process to stabilize the sizes of the inner and outer cloth layers 13 and 14 and the brush structure 15 of the double-knitted fabric 11. However, before the heat-setting process 40, the inner and outer cloth layers 13 and 14 and the brush structure 15 can undergo a water-repellent process so that a water repellent is adhered to the inner and outer cloth layers 13 and 14 and the brush structure 15 before heat setting.

At 50, two double-knitted fabrics 11 are cut and sewn, so that the outer cloth layers 14 face outward and that the inner cloth layers 13 face each other. A buoyant material 17 is filled in a receiving space 16 defined between the inner cloth layers 13. Since the brush structures 15 are light and air-permeable, the processing time can be shortened, and the thickness of the cloth layers 13, 14 can be increased. Furthermore, the processing efficiency is enhanced. Further, the labor hours and the material costs can be saved.

The life vest 1 according to the preferred teachings of the present invention can be manufactured without conventional bonding of artificial rubber sponges. Furthermore, the life vest 1 according to the preferred teachings of the present invention is light and air-permeable, providing enhanced wearing comfort without the problems of flimsiness, odor, and pollution after being discarded.

The double-knitted fabrics 11 can have any desired colors. Furthermore, the double-knitted fabrics 11 are smooth and elastic and provide firm hand-feel and water repellency including absorption of less water and fast drying features. The double-knitted fabric 11 has ball burst strength of 244 lb/cm$^2$, a web length of about 50-62 inches, and a weight of 300-600 g/y.

EXAMPLE

An artificial polyester filament of 100 denier and an artificial polyester filament of 150 denier were used as the material at a ratio of 55:45. The polyester filaments were knitted by a double circular knitting machine to produce double-knitted fabrics 11. The double-knitted fabrics 11 undergo the dyeing process 20, the brushing process 30, and the water-repellent process 41, the heat-setting process 40 and then the sewing process 50 including pattern making, cutting, and sewing to obtain the lightweight, air-permeable, water-repellent, high-strength, and elastic life vest 1 with double-knitted fabrics 11.

Table 1 shows differences between the finished textile of the life vest 1 according to the preferred teachings of the present invention and the rubber sponge fabric sheet for the conventional life vest.

TABLE 1

| Item | | Textile of the present invention | Conventional structure | Testing method |
|---|---|---|---|---|
| Weight (g/m$^2$) | | 356 | 504 | ASTM 3776 |
| Ball burst strength (lb/cm$^2$) | | 244 | 219 | ASTM 3787 |
| Breaking elongation (%) | warp | 97 | 191 | specimen 2.54 × 12 cm |
| | weft | 176 | 230 | |
| Water absorbing rate (%) | | 83 | 89 | Water bath for 60 minutes |
| Vaporization rate (%/30 min) | | 12 | 13 | Under room temperature for 30 minutes |
| Ventilation | | good | not good | — |
| Comfort | | good | bad | — |
| Odor | | no | yes | — |
| Application status | | repeatable, long Life span | easy to become flimsy, short life span | — |
| Environmental issue | | no | pollutant | — |

It can be appreciated that one of the double-knitted fabrics 11 of the life vest 1 according to the preferred teachings of the present invention does not have to include the brush structure 15 on the inner cloth layer 13.

Thus since the invention disclosed herein may be embodied in other specific forms without departing from the spirit or general characteristics thereof some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A method for making a life vest comprising:

making first and second double-knitted fabrics from an artificial filament, with each of the first and second double-knitted fabrics including an inner cloth layer and an outer cloth layer;

dyeing the first and second double-knitted fabrics;

processing the inner cloth layer of each of the first and second double-knitted fabrics after dyeing to form a brush structure on the inner cloth layer of each of the first and second double-knitted fabrics;

heat setting the brush structure and the inner and outer layers of each of the first and second double-knitted fabrics; and cutting and sewing the first and second double-knitted fabrics with the outer cloth layers facing outward, with the inner cloth layers facing each other, with a buoyant material filled between a receiving space defined between the inner cloth layers.

2. The method as claimed in claim 1, with the making the first and second double-knitted fabrics including making the first and second double-knitted fabrics from the artificial filament selected from at least one of a group consisting of a polyester filament, a polyamide filament, and a polypropylene filament and a combination thereof.

3. The method as claimed in claim 1, with making the first and second double-knitted fabrics including making the first and second double-knitted fabrics from the artificial filament by a circular knitting machine selected from one of a double knitting machine, a single knitting machine, and a terry knitting machine.

4. The method as claimed in claim 1, with processing the inner cloth layer of each of the first and second double-knitted fabrics after dyeing including processing the inner cloth layers to form the brush structure on the inner cloth layer of each of the first and second double-knitted fabrics, with an overall thickness of the inner cloth layer of each of the first and second double-knitted fabrics and the brush structure on the inner cloth layer being larger than a thickness of the outer cloth layer.

5. The method as claimed in claim 4, with processing the inner cloth layer of each of the first and second double-knitted fabrics after dyeing further including shearing and napping the brush structure of each of the first and second double-knitted fabrics.

6. The method as claimed in claim 1, further comprising processing the brush structure and the inner and outer layers of each of the first and second double-knitted fabrics before heat setting, so that the brush structure and the inner and outer layers of each of the first and second double-knitted fabrics are water-repellent.

* * * * *